United States Patent [19]

Krall

[11] Patent Number: 4,863,067

[45] Date of Patent: Sep. 5, 1989

[54] PLASTIC CONTAINER WITH SELF-DRAINING FEATURE

[75] Inventor: Thomas J. Krall, Toledo, Ohio

[73] Assignee: Owens-Illinois Plastic Products Inc., Toledo, Ohio

[21] Appl. No.: 160,555

[22] Filed: Feb. 25, 1988

[51] Int. Cl.[4] ..... B67D 1/16

[52] U.S. Cl. ..... 222/111; 222/571; 215/31

[58] Field of Search ..... 222/109, 111, 571, 568; 215/31; 141/381

[56] References Cited

U.S. PATENT DOCUMENTS

| | | | |
|---|---|---|---|
| 2,097,912 | 11/1937 | Burnham | 215/31 |
| 2,601,039 | 6/1952 | Livingstone | 222/109 |
| 2,743,844 | 5/1956 | Livingstone | 222/111 |
| 2,763,402 | 9/1956 | Livingstone | 222/111 |
| 2,793,790 | 5/1956 | Kahler | 222/109 |
| 2,873,403 | 9/1956 | Livingstone | 222/111 |
| 4,128,189 | 12/1978 | Baxter | 222/109 |
| 4,550,862 | 11/1985 | Barker et al. | 222/109 |
| 4,640,855 | 2/1987 | St. Clair | 428/36 |
| 4,671,421 | 6/1987 | Reiber et al. | 215/228 |
| 4,706,829 | 11/1987 | Li | 215/354 |

*Primary Examiner*—Joseph J. Rolla
*Assistant Examiner*—Kenneth Noland

[57] ABSTRACT

A plastic container and package having a self-draining feature is provided. The container includes a bottle with a dispensing spout which has a thread or other closure retention device molded therein and an annular sleeve encircling the spout and cooperating therewith to form a channel for capturing excess liquid flowing down the outside of the spout following dispensing of such liquids. An aperture is provided for draining liquid from the channel to the body portion of the container. A closure having thread or other retention device engages the closure retention device of the spout to form the remainder of the package.

6 Claims, 4 Drawing Sheets

PLASTIC CONTAINER WITH SELF-DRAINING FEATURE

This invention relates to plastic containers and more particularly to a container and package having a drain-back feature.

BACKGROUND ART AND SUMMARY OF THE INVENTION

In dispensing liquid from containers wherein only a portion of the contents of the container is used at any one time, as is the case with many products such as liquid detergents and bleaches, the consumer is concerned with the messiness which occurs from drops of the liquid contents draining down the neck and side of the container upon completion of pouring. Thus, when a bottle having an upper neck is turned from its normal upright storage position to an inverted dispensing position and then back to its upright position, a few drops of such liquid will invariably drain down the outside of the neck and side of the container. A number of prior art container designs have disclosed various features for capturing such excess fluid and causing it to drain back into the container rather than drip down the neck and side. Among such prior art containers are ones disclosed in U.S. Pat. Nos. 4,640,855; 4,671,421; and 4,550,862. Also pertinent are other types of dispensers cited as prior art in the above patents.

The container and package of the present invention represents an improvement over the prior art containers in that its design lends itself to ease of manufacture on a wide variety of machines readily available in the plastic molding industry. Additionally, such design permits economies of manufacture not available to those disclosed in the prior art. The container of the present invention includes a bottle with an integrally formed spout and finish having threads and a sleeve encircling the finish and cooperating therewith to form a channel. A closure having internal threads adapted to engage the finish forms the third and final portion of the package of the present invention.

In many prior art self-draining packages utilizing multiple members, an injection molded sleeve or collar is provided which is affixed in some manner to the bottle to provide the drain-back feature. In many of the prior art packages having self-draining features, which utilize a sleeve or collar, the sleeve or collar is provided with a thread or other closure retention means. In contrast, the collar utilized in the container and package of the present invention may have a smooth inner and outer surfaces and may thus be formed by a simple extrusion operation followed by cutting to the desired length. It is clearly more expensive to injection mold a sleeve or collar than it is to simply provide a sleeve which can be formed from a length of extruded plastic tubing.

According, it is an object of the present invention to provide a new and novel self-draining container which is economical to manufacture.

An additional object of the present invention is to provide a self-draining container and packaging which can be manufactured on a wide variety of plastic molding machines.

It is a further object of the present invention to provide a liquid dispenser package which provides for dispensing liquid contents from a container without the inconvenience of excess product dripping down the side of the container following dispensing.

Other objects of the invention will become obvious from the following description.

DESCRIPTION OF THE PREFERRED EMBODIMENT

Figure 1:
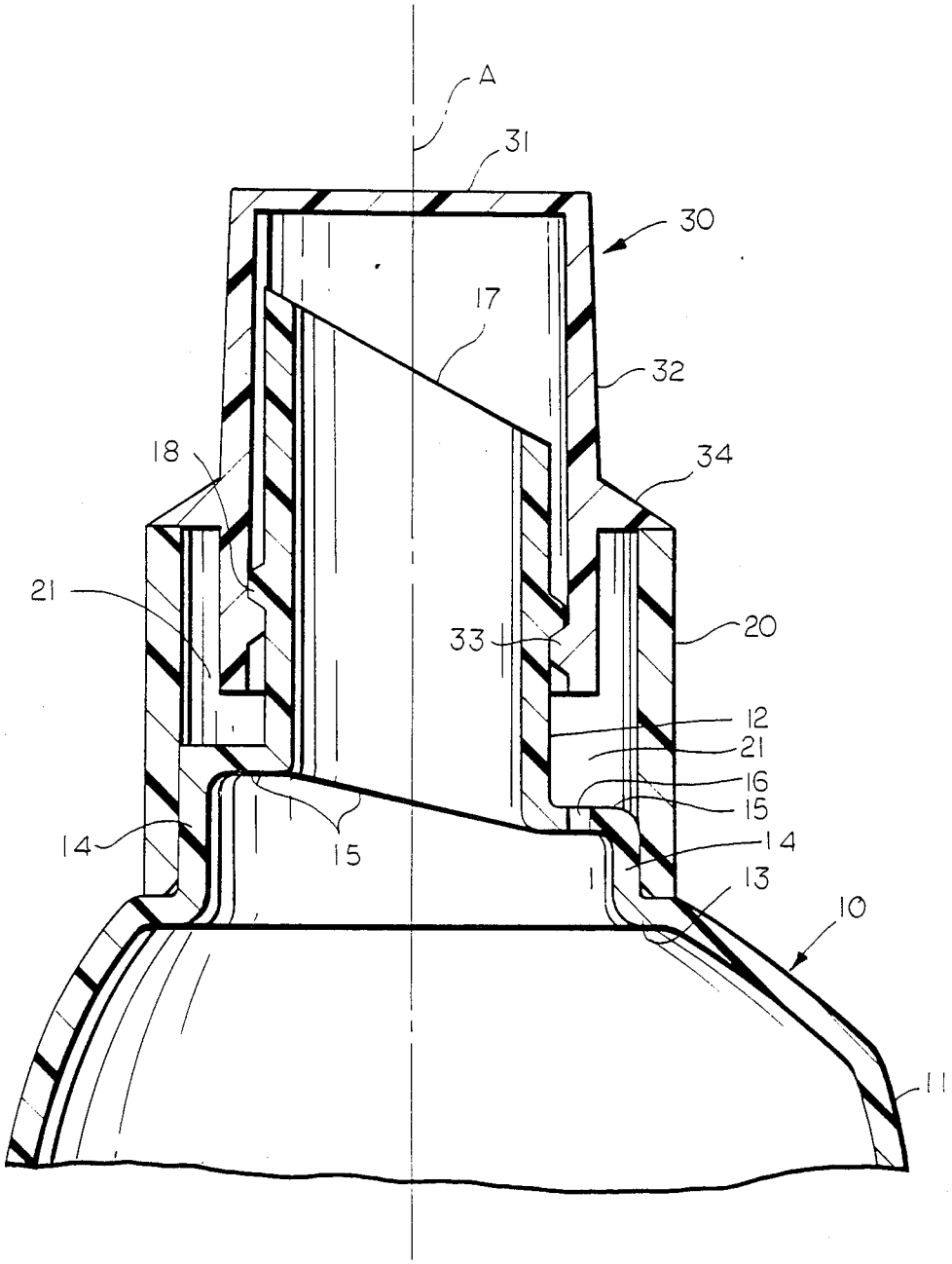
FIG. 1 is a partial sectional view taken through the top portion of the container of the present invention showing the bottle, sleeve and closure affixed thereto.
Figure 4:
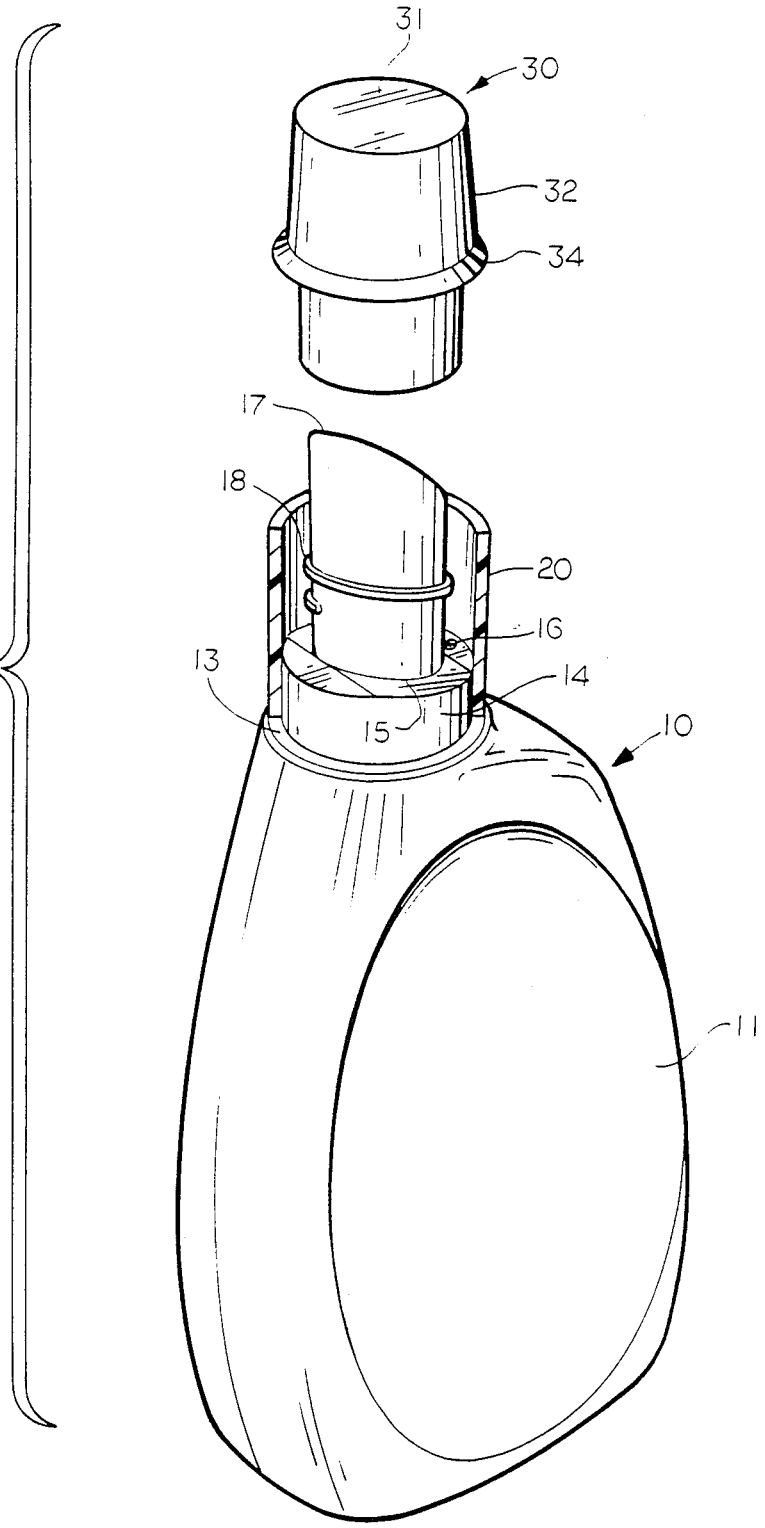
FIG. 4 is an exploded perspective view of the bottle, sleeve and closure of the embodiment shown in FIG. 1.

Referring now to FIGS. 1 and 4, there is shown a bottle generally designated 10 having a body portion 11 and terminating at its upper end in a combined finish and spout 12. The combined finish and spout 12 is integrally formed with the body portion 11 and is joined thereto by a transition area which includes a horizontal ledge 13 joined to a short cylindrical wall 14 which is parallel to the axis A of the combined finish and spout 12. The wall 14 extends a greater axial distance on one side, the left as shown in FIG. 1, than on the other and has a radial ledge 15 extending inwardly from its upper portion. The ledge 15 is joined at its inner edge to the bottom of the combined spout and finish 12. By virtue of the cylindrical wall 14 having a greater axial height on one side than on the other, it will be seen that the ledge 15 slopes downwardly, from left to right as shown in FIG. 1 when the bottle 10 is in its upright position for storage. The ledge 15 has an aperture 16 formed on the lower-most portion thereof which communicates with the interior of the body portion 11.

As previously mentioned, the combined spout and finish 12 extends axially upwardly on the inner edge of the ledge 15. Preferrably the top edge 17 of the combined finish and spout 12 is tapered so that the side which is opposite the aperture 16 is higher than the side adjacent the aperture 16. Thus, in FIG. 1 the left side of the upper edge 17 is significantly higher than the upper edge portion on the same side as the aperture 16. Although this is not critical from the standpoint of operation of the invention, it serves to readily advise the user of the desired direction for pouring the liquid contents from the bottle 10. Thus, it would not be desirable to pour the contents by tipping the container toward the right in FIG. 1 as a portion of such contents would flow through the aperture 16.

A second element of the container and package of the present invention is a cylindrical sleeve 20 which may be formed in a separate molding operation and which is adhered to the cylindrical wall portion 14 and/or the ledge or shoulder portion 13 by one of numerous methods which are well-known to those skilled in the art such as, for example, by adhesive or spin welding. The cylindrical sleeve 20 extends axially upwardly to a point higher than the highest portion of the ledge 15 but significantly below the top 17 of the combined finish and spout 12. As can be readily seen from FIG. 1, the cylindrical sleeve 20 cooperates with the outer surface of the combined finish and spout 12 and with the upper surface of the ledge 15 to form an annular drain channel 21. Thus, any liquid which drains down the outside of the combined spout and finish 12 will be captured in the channel 21 and, by virtue of the fact that the ledge 15 is tapered downwardly on one side, such fluid will be directed to a lower portion of the channel at which point it will flow through the aperture 16 to drain back into the body portion 11 of the bottle 12.

Formed on the exterior surface of the combined finish and spout 12 are closure retention means 18. Preferrably, such closure retention means is a simple screw thread.

There is also provided a closure generally designated 30 for sealing the container 10 and for thus forming the remainder of the package of the present invention. The closure has a top panel 31 with an annular skirt 32 depending therefrom. The skirt has threads 33 or other closure retention means which are adapted to engage the thread or closure retention means 18 on the outer surface of the combined finish and spout 12. Extending radially outwardly from the skirt 32 is a flange 34 positioned to sealingly engage the upper surface of sleeve 20 when the closure 30 has its threads 33 fully engaged with the closure retention means 18 of the container.

One of a number of methods of blow molding well-known to those skilled in the art may be used to mold the bottle portion of the container and package of the present invention. In the embodiment of FIG. 1, the combined finish and spout 12, including the threads 18, is injection molded while the remaining portion of the bottle 10 is blow molded. As such, the container may be formed by the process disclosed in Sherman, U.S. Pat. No. 2,804,654, which is incorporated herein by reference. This type of blow molding may be characterized as injection-extrusion blow molding and is used by the assignee of the present invention and others with a machine designated as a BC-3 machine.

In the method utilized by the BC-3 machine, the upper neck or finish portion of the container is first injection molded in an injection mold. Upon completion of the injection molding step, the injection mold is raised from the orifice of the injection die head while a length of heated and plasticized tubing is extruded from the die head. The tubing is connected to the injection molded finish and is drawn upwardly as the tubing is extruded. After the proper length of tubing has been extruded, blow mold halves close around the tubing and air is introduced through the injection mold assembly to expand the tubing in the closed mold to form the remainder of the container. These steps are shown and described in U.S. Pat. No. 2,804,654.

Another type of blow molding machine which could be utilized to form the container shown in the FIG. 1 embodiment of the present invention is a blow molding machine well-known in the industry as an injection-blow type blow molding. Blow molding machines of this type include ones manufactured by Jomar Manufacturing of Brigentine, NJ and Nissei of Tokyo, Japan. In these types of machines, the entire parison from which the bottle is blown is injection molded in the mold cavity. The injection molded parison is then transferred to a blow mold where the body portion 11 of the bottle is blown. Another type of blow molding operation which could be utilized to form a container of the embodiment of FIG. 1 is that shown in U.S. Pat. Nos. 3,599,280 or 4,214,860.

Figure 2:
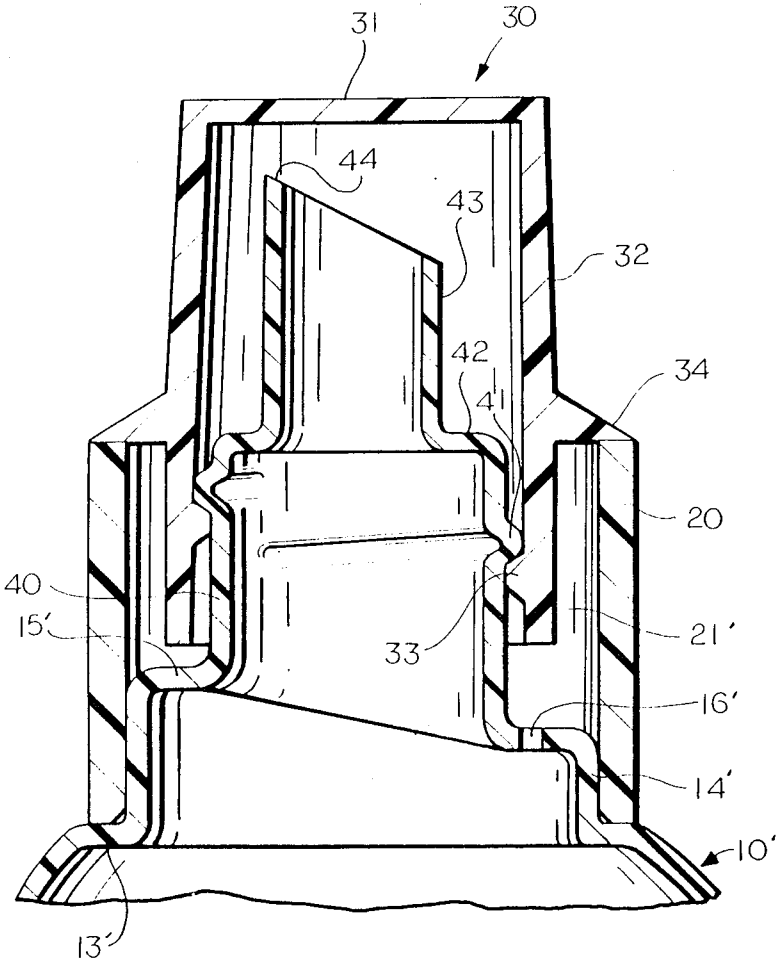
FIG. 2 is a view similar to FIG. 1 of another embodiment of the present invention.
Figure 5:
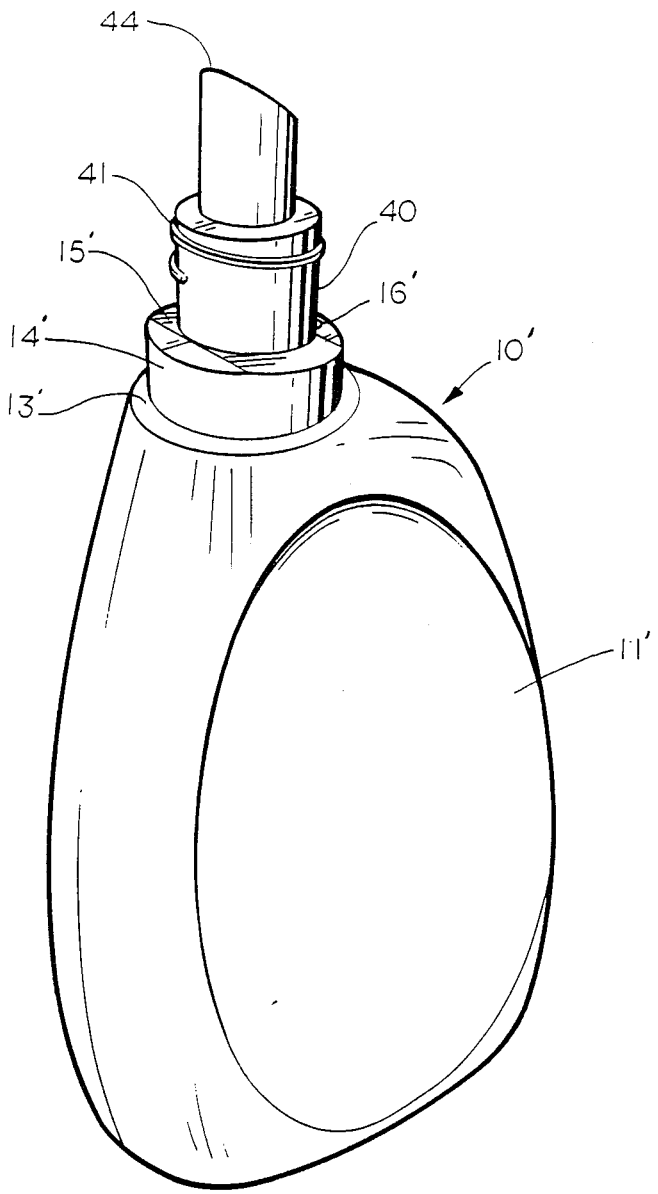
FIG. 5 is a perspective view of the bottle only showing the embodiment of FIG. 2.

Referring now to FIG. 2, there is shown another embodiment of the container and package of the present invention. FIG. 5 shows the bottle portion only of such embodiment. In this embodiment, the entire bottle, including the spout and finish portion may be manufactured by extrusion blow molding process. This gives the present invention much wider potential utilization as many companies prefer to use that type of blow molding process in their operations. Additionally, for certain sizes and shapes of bottles extrusion blow molding is perferred while for other sizes and shapes, the previously described injectionextrusion blow molding or injection blow molding type processes are preferred. Bottles of the type shown in the embodiment of FIGS. 2 and 5, may be formed on a number of machines which operate according to a process in which continuously extruded tubing has a length severed therefrom and then is moved by a shuttling blow mold to a blowing station where the bottle is blown while the next successive length is being extruded. The next successive length may be moved by a second set of blow molds to a second blowing station for blow molding into a bottle. Machines of this type are manufactured by a number of companies including Bekum Maschinen-Fabriken GmbH of West Berlin, Krupp Kautex Maschinenbau of Bonn, West Germany, and Battenfeld Fischer of Lohmar, West Germany, and are disclosed in various U.S. patents, including U.S. Pat. No. 3,583,031. Additionally, such bottle may be manufactured on machines known as wheel-type blow molding machines of the type disclosed in U.S. Pat. No. 4,549,865 assigned to the assignee of the present invention.

The bottle 10' shown in the embodiment of FIGS. 2 and 5 includes a body portion 11', a radial ledge 13' at the upper end thereof and a cylindrical wall 14' extending upwardly from the ledge 13'. Also provided is a radial ledge 15' which is higher on one side of the container (the left as viewed in FIG. 2) and which is provided with an aperture 16' at the lower portion thereof, which aperture communicates with the body portion 11'. Extending upwardly from the ledge 15' is a blown finish 40 having a thread 41 or other closure retention means formed in the exterior wall thereof. As may be seen in FIG. 2 the threads 40 are simply blown in such finish 40 during the blow molding operation.

In this embodiment there is also provided an additional horizontal ledge 42 joined to the upper portion of the finish 40 from which a spout 43 extends axially upwardly. As in the previous embodiment, preferrably, one side of the spout 43 will extend higher than the other side. This is shown at 44 in FIGS. 2 and 5. The higher portion of the spout should, of course, be on the opposite side from the aperture 16'.

The bottle of the embodiment shown in FIG. 2 is provided with a cylindrical sleeve 20 as in the previous embodiment. This sleeve cooperates with the exterior surface of the finish 40 and the ledge 15' to form a channel 21' which captures excess fluid flowing down the exterior surface of the spout 43 and finish 40 following dispensing of liquid contents from the container 10'. The closure 30 of the embodiment shown in FIGS. 2 and 4 is identical to that shown in the embodiment of FIG. 1 and sealingly engages the upper surface of the sleeve 20 when its thread 33 is fully engaged with the thread 41 of finish 40.

As will be appreciated by those skilled in the art, if desired, it is possible to form the bottle portion of the container of the present invention by injection molding the spout 43 and blow molding the remainder of the bottle 10' including the finish portion 40 and thread 41.

Figure 3:
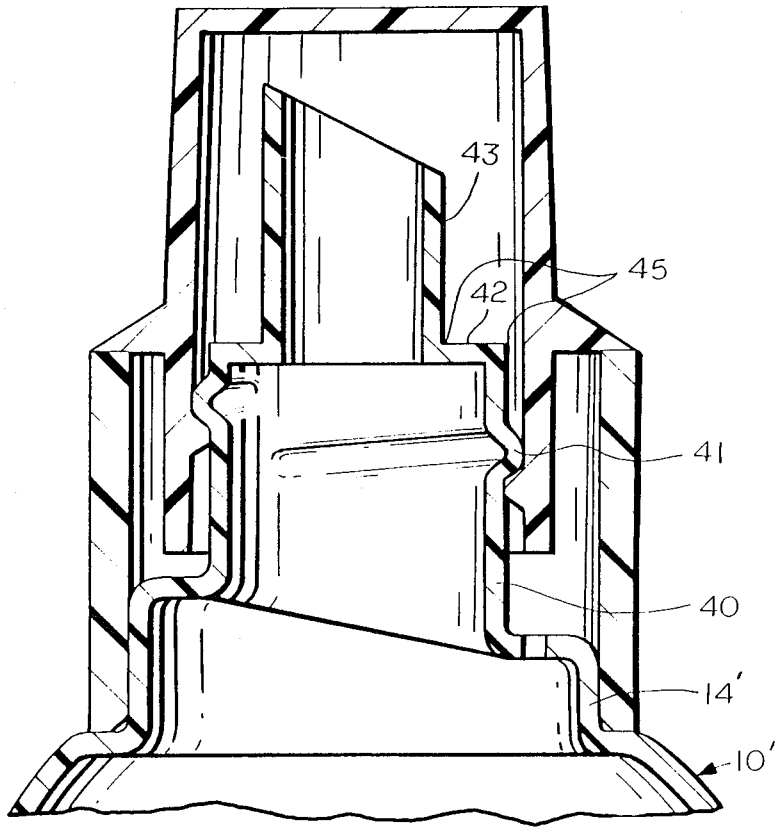
FIG. 3 is a view similar to FIGS. 1 and 2 showing yet another embodiment.

This may be seen from FIG. 3 in which the outer corners of the ledge 42 are illustrated as having sharper corners 45 and 46 than is obtained when similar portions are blow molded.

It will be readily appreciated by those skilled in the art that the container of the present invention is one which effectively captures the excess fluid flowing down the outer surface of the spout and yet is one which is readily adaptable to manufacture by a wide variety of machines and processes. Additionally, the fact that the bottle itself is provided with threads or other closure retention means permits a simple economical tubular segment to be provided for forming a portion of the channel. The fact that the tubular segment 20 can be formed by a simple extrusion process rather than by a more expensive injection molding process utilized in many of the prior art containers of this type further enhances the desirability of the container and package of the present invention.

A wide variety of modifications will be readily apparent to those skilled in the art. The scope of the present invention should be limited only by the scope of the appended claims.

We claim:

1. A self-draining container comprising in combination:

(a) a bottle having (i) a body portion having an annular wall portion at its upper end, an integral flange extending inwardly from the upper portion of said annular wall, said flange having aperture means communicating with the interior of said body portion;

(ii) an integral spout member extending generally upwardly from said flange, said spout having a cylindrical portion of a smaller diameter than the smallest cross-sectional size of said annular wall portion, the cylindrical portion of said spout having thread means on the exterior surface; and (b) an annular sleeve encircling and sealingly connected to said annular wall, said sleeve cooperating with said spout and with the upper surface of said flange to define a channel for collecting excess fluid draining down the outside surface of said spout following dispensing of fluid therethrough, said channel configured to direct such excess fluid to said aperture when the bottle is in its upright storage position, the top of said spout extending upwardly beyond the top of said annular sleeve.

2. A self-draining container comprising in combination:

(a) a bottle having (i) a body portion having an annular wall portion at its upper end;

(ii) an integral flange extending inwardly from said annular wall;

(iii) an integral spout member extending generally upwardly from said flange, said spout having closure retention means on the exterior surface thereof;

(b) an annular sleeve encircling and sealingly connected to said annular wall, said sleeve cooperating with said spout and with the upper surface of said flange to define a channel for collecting excess fluid draining down the outside surface of said spout following dispensing of fluid therethrough, said flange having aperture means communicating with the interior of said body portion; said channel configured to direct such excess fluid to said aperture when the bottle is in its upright storage position.

3. A container as defined in claim 2 wherein the spout including the closure retention means is formed by injection molding and the body portion is formed by blow molding.

4. A container as defined in claim 2 wherein the entire bottle including the spout and closure retention means is formed by blow molding.

5. A container as defined in claim 2, further including a closure having a top panel and an annular skirt depending therefrom, said annular skirt (i) sized to telescope around said spout;

(ii) having retention means on the inner surface thereof adapted to engage the closure retention means of the spout; and, (iii) having an annular flange extending outwardly from the outer surface at a location to sealingly engage said annular sleeve when the retention means of the closure is engaged to the closure retention means of the spout.

6. A self-draining package comprising in combination:

(a) a bottle having (i) a body portion having a annular wall portion at its upper end, an integral flange extending inwardly from the upper portion of said annular wall, said flange having aperture means communication with the interior of said body portion;

(ii) an integral spout member extending generally upwardly from said flange, said spout having a cylindrical portion of smaller diameter than the smallest cross-sectional size of said annular wall portion, the cylindrical portion of said spout having thread means on the exterior surface;

(b) an annular sleeve encircling and sealingly connected to said cylindrical wall portion, said sleeve cooperating with said spout and with the upper surface of said flange to define a channel for collecting excess fluid draining down the outside surface of said spout following dispensing of fluid therethrough, said channel configured to direct such excess fluid to said aperture when the bottle is in its upright storage position, the top of said spout extending upwardly beyond the top of said annular sleeve; and, (c) a closure having a top panel and an annular skirt depending therefrom, said annular skirt (i) sized to telescope around said spout;

(ii) having thread means on the inner surface thereof adapted to engage the thread means of the spout; and, (iii) having an annular flange extending outwardly from the outer surface at a location to sealingly engage said annular sleeve when the respective thread means of the closure and spout are engaged.

* * * * *